US006626443B2

(12) United States Patent
Lafond

(10) Patent No.: US 6,626,443 B2
(45) Date of Patent: Sep. 30, 2003

(54) RETRACTABLE GUIDE MEANS FOR A SNOWBOARD

(76) Inventor: Luc Lafond, 23 Woodvalley Drive, Etobicoke, Ontario M9A 4H4 (CA)

( * ) Notice: Subject to any disclaimer, the term of this patent is extended or adjusted under 35 U.S.C. 154(b) by 0 days.

(21) Appl. No.: 10/136,515

(22) Filed: May 2, 2002

(65) Prior Publication Data

US 2002/0121751 A1 Sep. 5, 2002

Related U.S. Application Data

(63) Continuation-in-part of application No. 09/725,134, filed on Nov. 29, 2000, now abandoned.

(51) Int. Cl.[7] ..... B62M 9/04

(52) U.S. Cl. ..... 280/14.24; 280/605; 280/14.22; 280/604

(58) Field of Search ..... 280/14.21, 14.22, 280/605, 601, 602, 614, 615, 617, 608, 809, 14.28, 604, 28.11, 618, 14.24; 441/68, 70, 74; 36/115

(56) References Cited

U.S. PATENT DOCUMENTS

| | | | | | |
|---|---|---|---|---|---|
| 1,101,631 | A | * | 6/1914 | Jacques | 280/605 |
| 2,187,437 | A | | 1/1940 | Wanat | 280/18 |
| 2,302,478 | A | * | 11/1942 | Snow | 280/605 |
| 2,955,300 | A | | 10/1960 | Hedlund et al. | 9/310 |
| 3,782,744 | A | | 1/1974 | Milovich et al. | 280/18 |
| 3,783,108 | A | * | 1/1974 | Lacarrau et al. | 280/604 |
| 4,109,931 | A | * | 8/1978 | Woitschatzke et al. | 280/605 |
| 4,398,746 | A | * | 8/1983 | Heintz | 280/604 |
| 4,599,072 | A | * | 7/1986 | Pollini et al. | 441/65 |
| 4,763,918 | A | * | 8/1988 | Sedlmair | 280/605 |
| 4,805,546 | A | * | 2/1989 | Geller et al. | 441/74 |
| 4,969,655 | A | * | 11/1990 | Katz | 280/14.22 |
| 4,974,868 | A | | 12/1990 | Morris | 280/609 |
| 5,035,443 | A | | 7/1991 | Kincheloe | 280/618 |
| 5,040,819 | A | | 8/1991 | Horn | 280/618 |
| 5,135,249 | A | | 8/1992 | Morris | 280/609 |
| 5,143,008 | A | * | 9/1992 | Hall | 441/74 |
| 5,356,168 | A | | 10/1994 | Ozburn | 280/605 |
| 5,433,636 | A | * | 7/1995 | Gillis | 441/74 |
| 5,591,059 | A | * | 1/1997 | Lehman | 441/68 |
| 5,692,323 | A | * | 12/1997 | Goldberg | 36/115 |
| 5,984,343 | A | * | 11/1999 | Longoni et al. | 280/602 |
| 6,007,101 | A | | 12/1999 | Pritchard et al. | 280/809 |
| 6,022,040 | A | | 2/2000 | Buzbee | 280/613 |
| 6,220,631 | B1 | | 4/2001 | Pritchard et al. | 280/809 |
| 6,264,215 | B1 | | 7/2001 | Carlson et al. | 280/14.21 |
| 6,308,978 | B1 | | 10/2001 | Kelman | 280/608 |

FOREIGN PATENT DOCUMENTS

| | | | | | |
|---|---|---|---|---|---|
| DE | 3140413 | A1 | * | 7/1982 | A63C/7/10 |
| DE | 3334488 | A1 | * | 3/1984 | A63C/7/06 |
| DE | 3415641 | A1 | * | 10/1984 | A63C/7/06 |
| GB | 2080123 | A | * | 2/1982 | A63C/9/08 |

* cited by examiner

*Primary Examiner*—Brian L. Johnson
*Assistant Examiner*—Hau Phan
(74) *Attorney, Agent, or Firm*—McFadden, Fincham

(57) ABSTRACT

A multi-position binding system for snowboards having at least two preset positions, including a first position where the user is able to control the snowboard under conventional use, and a second position where the user is able to rotate the binding systems to extend a guide blade through a slot from a recessed position within the core of the board. The blade when in use projects from the bottom surface of a snowboard to provide guide means to aid the user in controlling the direction of the snowboard during forward movement.

20 Claims, 11 Drawing Sheets

RETRACTABLE GUIDE MEANS FOR A SNOWBOARD

This application is a continuation-in-part of U.S. patent application Ser. No. 09/725,134, filed Nov. 29, 2000, now abandoned.

FIELD OF INVENTION

This invention relates to guide means for snowboards and a method for propelling the snowboard in a desired direction.

BACKGROUND ART

Snowboards have gained popularity and acclaim over the years, rising from a recreational sport or hobby to a recognized Olympic sport. As such, innovations from materials used in snowboard construction to bindings have resulted in high performance boards and binding systems adapted for many different types of uses, such as for slalom, freestyle, etc.

One drawback of today's snowboard is that during non-downhill motion, forward movement is difficult to control. For example, moving to and from the lift, chalet or otherwise getting from one point to another along a flat surface or stretch, is a difficult and labourious process, especially without having the benefit of any previous substantial momentum. Typically, snowboards, generally have a flat or convex bottom surfaces, which tend to slip or slide sideways as their design is intended for manoeuvring down a ski slope rather than for gliding or moving in a controlled straight path along a flat surface. In order to get from a starting point to the lift, the rider has to either completely remove his or her feet from the binding systems and walk, or at least remove one foot or boot from a binding and push the snowboard along with the opposite foot while trying to adjust for the sideways slide or slippage of the board while maintaining his balance.

In the prior art, Pritchard U.S. Pat. No. 6,220,631 discloses a skeg structure in which a snowboard is provided with skegs extending completely through the board and which are in certain embodiments mounted at the rear of the board. The skegs are generally held in a locked position, and are stated to be useful f or tracking and stability over snow surfaces. In the arrangement disclosed, the skeg is manually lowered into snow contact and maintained in the position with a thumb-screw forcing the skeg into continuous contact with the snow.

In contrast to the arrangement of the present invention, this reference does not have a guide in which the user while engaging a harness or binding mechanism, can lower and raise the guide means into and out of operative position, when it is desired to move or glide across a flat surface, as opposed to downhill usage.

SUMMARY OF THE INVENTION

The present invention also provides a combination of a binding and guide means which can be mounted to a conventional snowboard where the snowboard is provided with a recess for the guide means. In particular, the provision of a binding and guide means can thus provide existing snowboards with added features, which heretofore were not available in the post-market field whereby existing snowboards could be modified to provide improved characteristics.

The present invention addresses the above problem by providing a means to allow a rider to turn the binding in-line with the snowboard and a second means to facilitate tracking of the board. The tracking means consists of a retractable skate or blade which the rider may push down to a act as a guide fin, blade keel or the like, under the snowboard when pushing or skating,for example when travelling along a flat or going to or from a lift line. According to one aspect of the present invention, there is provided a retractable guide blade which allows a user to push or skate in a manner similar to that of a technique used for pushing a skateboard and move, or push forward without sliding sideways. By turning at least the front foot, it is less stressful on the knees and provides for a much more ergonomic or natural position while pushing the board with one foot.

In accordance with the present invention and in accordance with one embodiment thereof, there is provided a snowboard having a binding and retractable guide means, said guide means comprising a movable blade movable between a first retracted position within said board and a second extended position exteriorly of a bottom surface of said board, said guide means and said binding means being operatively associated with one another, with said guide means being movable between said first and second positions by said binding.

In the above embodiment, preferably the board includes spaced apart upper and bottom surfaces with a core therebetween, said core having an aperture extending inwardly from said bottom surface and adapted to receive said blade when in a retracted position.

A preferred embodiment of the present invention thus provides a multi-position binding system a retractable blade which aids a user to control the forward movement of a snowboard.

The present invention thus allows the user to have a more ergonomic stance and position during a controlled forward movement through the combination of a multi-position binding system having a retractable guide blade.

In another aspect of the present invention, a preferred form of the retractable guide means is where the guide means comprises a movable blade movable between a first retracted position within the board and a second extended position exteriorly of a bottom surface of the board, where the blade means has an actuation means associated with a binding for raising and lowering the blade between a first and second position.

In another aspect of the present invention, the guide means comprises at least one movable blade movable between a first retracted position within a board and a second extended position exteriorly of a bottom surface of a board.

A preferred form of means for retaining the blade comprises an insert formed into the core of a snowboard, where the insert has a flexible structure adapted to engage opposed sides of the blade, wherein the flexible structure is positioned within the aperture to prevent snow or ice interfering with movement of the blade.

According to another embodiment of the invention, there is provided a binding suitable for use with a snowboard, the combination of binding means and guide means, the guide means comprising a movable blade movable between a first retracted position within a snowboard and a second extended position exteriorly of a bottom surface of a snowboard; the binding means comprising a binding adapted to be secured to a snowboard and to retain a snowboard user's foot; the binding means being operatively associated with said guide means when assembled to a snowboard to thereby actuate said movable blade to place said blade in said second extended position.

According to the above embodiment, desirably the guide means includes an insert adapted to be positioned in an aperture in a snowboard to receive the blade of the guide means when in a retracted position, the insert comprising a flexible housing adapted to engage opposed sides of the blade when the blade is in a retracted position in a snowboard to prevent snow or ice interfering with the movement of the blade.

Again, according to a preferred form of the above embodiment, the binding includes rotatable means operatively associated with said guide means whereby rotation of said rotatable means of said binding lowers said blade from said first position to said second position.

In a particularly preferred embodiment of the above arrangement, the binding means comprises a rotatable assembly rotatable between first and second positions, the assembly including a swivel plate, guide means for guiding the swivel plate between the first and second positions, means for retaining the rotatable assembly fixedly secured to an upper surface of the snowboard.

BRIEF DESCRIPTION OF DRAWINGS

Having thus generally described the invention, reference will now be made to the accompanying drawings illustrating preferred embodiments in which.

DETAILED DESCRIPTION OF THE PREFERRED EMBODIMENTS

Figure 1:
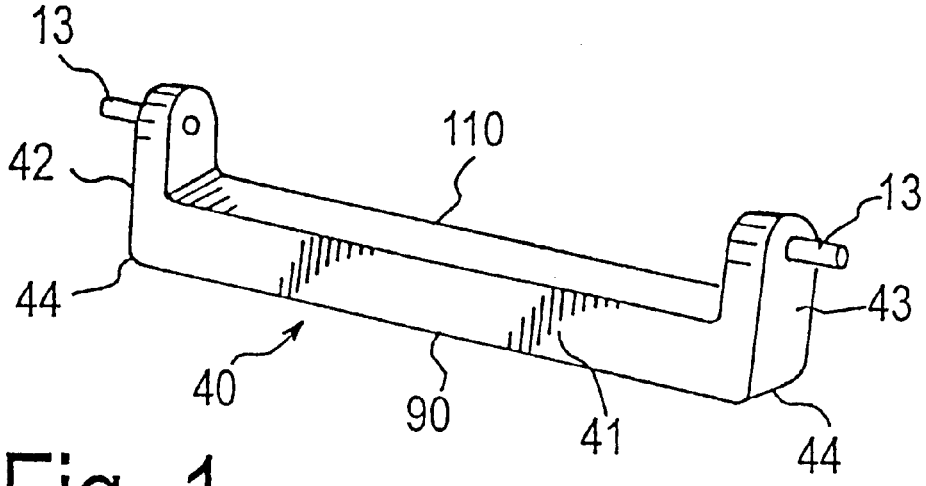
FIG. 1 is a side elevational view of a guide blade according to a preferred embodiment of the present invention.

Referring now to the drawings, the system of the present invention provides a snowboard having a binding, and means associated with the binding for raising and lowering guide means. For ease of explanation, reference will be made to the guide means initially, with the binding components described as being in association therewith.

According to a preferred embodiment of the present invention, there is provided a retractable guide means for snowboards, including an actuation guide 10, an aperture 160, a skate or blade holder 20, and guide means in the form of a skate or blade 40. The blade or skate 40 as discussed herein is understood to incorporate retractable guide means, such as a skate, blade or the like which in use extends from a recessed position within the snowboard to act as a keel or rudder, to provide positive traction when the rider is pushing the board. Similarly, the aperture 160 as discussed herein is understood to incorporate shapes or combination of shapes, which allow for the blade to extend from within the aperture through the bottom of the snowboard.

As illustrated in FIGS. 1 through 6, there is provided a guide means for use in conjunction with the binding. The guide means is in the form of a skate or a blade 40, which provides positive traction for the rider of the snowboard 150 when in an extended or in use position. In use, the blade 40 may act as a keel or ridge to provide positive traction. As illustrated, the blade 40 includes retaining or locking pins 13 or other suitable means adapted to moveably retain or lock the blade 40 within the actuation guide 10 through a blade holder 20. A blade holder is part of the binding sub-plate or can be independently held in the snowboard core. Desirably, a conventional snowboard 150 would be provided with a slot or corresponding aperture 160 adapted to receive the blade 40 along a substantially longitudinal axis to the board. Most desirably, the aperture 160 is positioned beneath the binding or binding system mounting area, as this location or position of the retractable guide means optimizes control of the board by the user during skating or pushing of the board.

Figure 2:
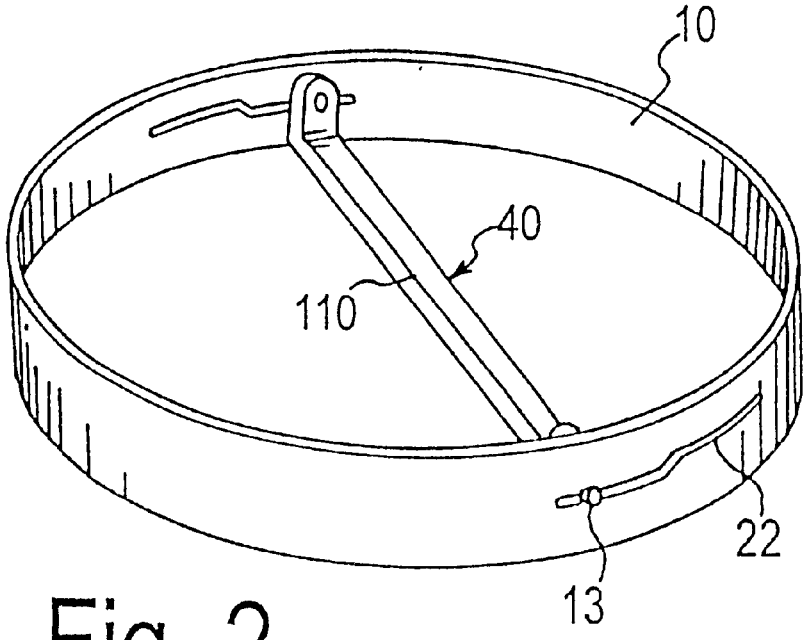
FIG. 2 is a side elevational view of the guide means positioned within a guide blade holder.

As illustrated in FIG. 2, the member 10 includes a guide or groove 22, having a form of a generally S-shape or configuration. The retaining pins 13 of the guide blade 40 are adapted to inserted into the S-shaped guide 22. In use, the actuation guide 10 is rotated by the binding (described hereinafter) which allows the pins to travel along the guide 22 and allows the blade 40 to lower or raise, thus extending or retracting the guide blade 40 from a recessed position within the snowboard 150 or snowboard core 155. The actuation guide 10 may be used in combination with a binding plate or attachment plate of a modified snowboard binding system, or may be a separate element adapted to attach to a conventional binding systems. In the present embodiment, the actuation guide 10 is adapted to rotate between a first position and at least one second position, where as the actuation guide 10 rotates, the skate or guide blade holder 22 engages with the pins 13 which, from a retracted position within the snowboard, forces the blade 40 in a downward direction extending at least a portion of the blade 40 from underneath the snowboard.

In the above example, when the rider's foot, mounted preferably in a binding, is turned in line with the longitudinal axis of the board, the holder 22 is rotatably driven, thus forcing the member 40 to move downwardly relative to the board via a cam-like action. This in turn forces the blade 40 to extend below the lower face of the snowboard to provide a keel-like function. When the rider rotates his foot in the opposite direction, the actuation guide 10 rotates, causing the skate holder 20 draw the blade 40 in an upward direction, thereby ensuring that when the users foot is in a first or non-actuated position, the blade portion is recessed within the core of the snowboard.

The blade 40 may be positioned either in a slot and/or recess 160 directly in the snowboard, or alternatively the blade portion could be used with an insert or holder 20, adapted to hold or guide the blade. Preferably, the blade 40 is provided with at least one angular or sloping end surface 44, which is curved to provide a smooth or curved surface for providing the keel-like function.

As previously mentioned, the present invention also provides a combination of a binding and guide means, which can be used to be mounted on any conventional type of snowboard. In such an arrangement, the snowboard may be provided with a suitable aperture or recess to receive the guide means or alternatively, snowboards provided with pre-formed apertures may be used. In that arrangement, the binding can be mounted to the snowboard above the aperture by suitable means and the guide means inserted into the aperture and then operatively connected to the binding. Depending on the type of binding (e.g. one which uses a rotatable plate as described hereinafter), the binding will be directly or indirectly connected to the guide means to actuate the same.

Desirably, the pins or extrusions 13 are coated with a non-stick material, a rubberized coating or may be formed from a rubberized material, i.e., silicone, urethane or other flexible, elastic material. This non-stick coating material could also be selected from the group including Teflon or nylon, combinations thereof or derivatives thereof. Alternatively, the pins could be replaced by bushings or the like.

Figure 3:
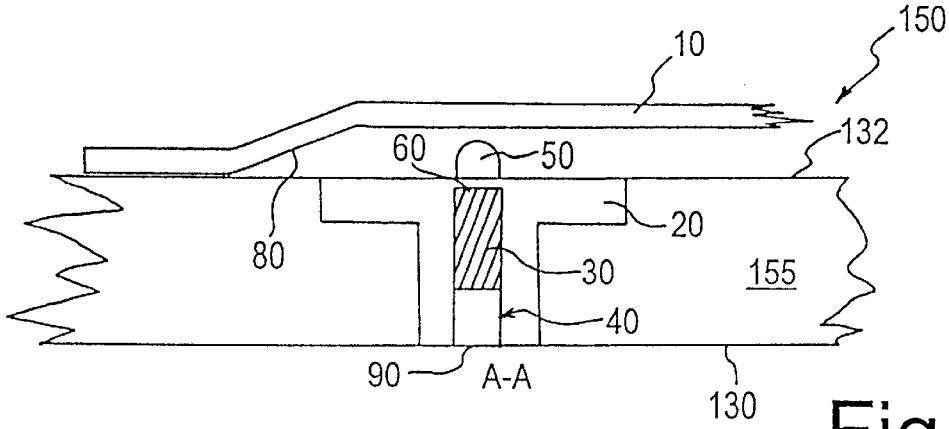
FIG. 3 is a cross section view taken along lines of FIG. 4 and guide blade insert within a core of a snowboard.
Figure 4:
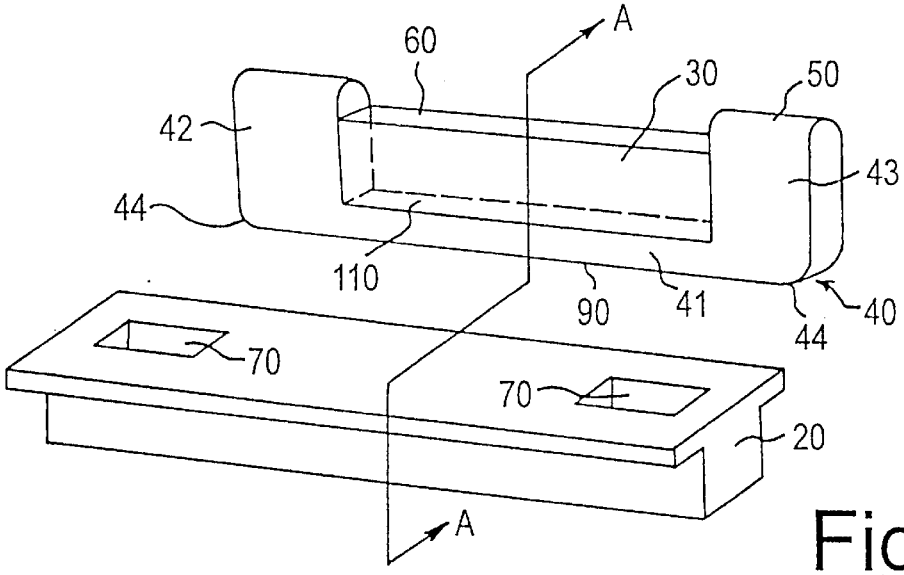
FIG. 4 is an exploded view of the insert showing the guide blade and the guide blade holder.

In an alternative embodiment, as illustrated in FIGS. 3 and 4, the retractable blade means 40 is adapted to be used as an insert, and placed within a recess or suitable housing within the snowboard 150 or snowboard core 155.

FIG. 3 illustrates the retractable blade means as positioned within a snowboard 150 in a retracted or non-use position. As illustrated, the blade 40 is in a retracted position within the skate or guide blade holder 20, which is positioned immediately or substantially directly beneath the binding system or actuation guide 10 of the snowboard 150. Actuation guide 10 as shown includes a binding engaging surface, which when actuated by the rider or user, engages with an upper portion 50 of the blade 40 through the apertures 70, which extends at least a portion of the blade 40 through the skate holder 20 and thus extends the blade 40 beneath the bottom surface 130 of the snowboard 150. The blade 40 includes a lower surface 90, and in the preferred embodiment is flush or co-planar with the bottom surface 130 of the snowboard 150 when in a normal or non-actuated use.

FIG. 4 illustrates an exploded view of the blade 40 and the skate or blade holder 20. As illustrated, there is provided for use with a snowboard 150, a generally T-shaped skate holder 20 having apertures 70, and is adapted to house therein a skate or blade 40. Blade 40 according to the present embodiment may be in the form of an elongated U, or C-shaped configuration, having a bottom 41, and opposed ends 42 and 43, wherein at least one end includes curved or a sloped surface 44. Desirably, flexible material 30 is positioned between the ends 42 and 43, and is affixed through conventional means (i.e., bonded, glued or the like) to the interior portion 110 of the skate or blade 40. The blade 40 has an upper surface 50 of opposed ends 42 and 43 which are adapted to protrude through apertures 70. Apertures 70 are adapted to permit the upper portions 50 to protrude there through to operatively engage with binding engagement surface of the actuation guide 10.

Flexible material 30 as illustrated includes an upper surface 60, which in use is adapted to be affixed to the upper portion 120 of the interior of the holder 20. The flexible material 30, such as silicone, urethane, or the like, is preferably fabricated from conventional materials able to remain flexible under cold conditions, and desirably retains a "memory" which enables the material to easily return to its original shape. Such materials could include non-stick coatings, such as Teflon or the like, and or other rubberized coatings as described above.

Figure 5:
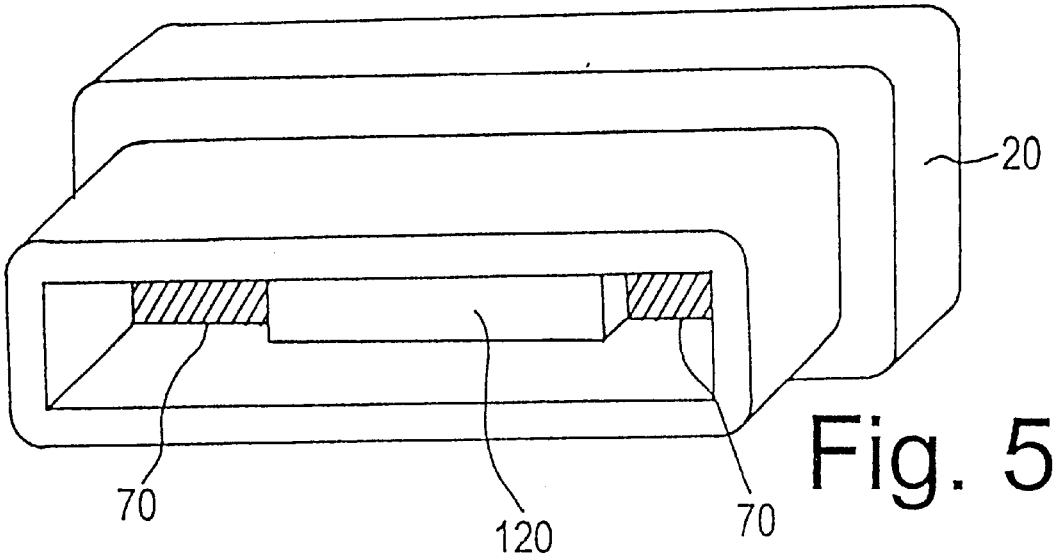
FIG. 5 is a bottom elevational view of an alternative embodiment of a guide blade holder.

FIG. 5 illustrates an alternative embodiment of the skate or blade holder 20, having a generally rounded or ovoid exterior configuration, and an interior which is adapted to receive the blade 40 as described herein. An upper surface 120 is shown positioned between apertures 70, which in use, is adapted to receive the upper portion 60 of the flexible material 30. As described above, the upper surface 60 of the flexible material 30 is adhered to the upper interior surface 120 of the holder 20 through any conventional means.

Figure 6:
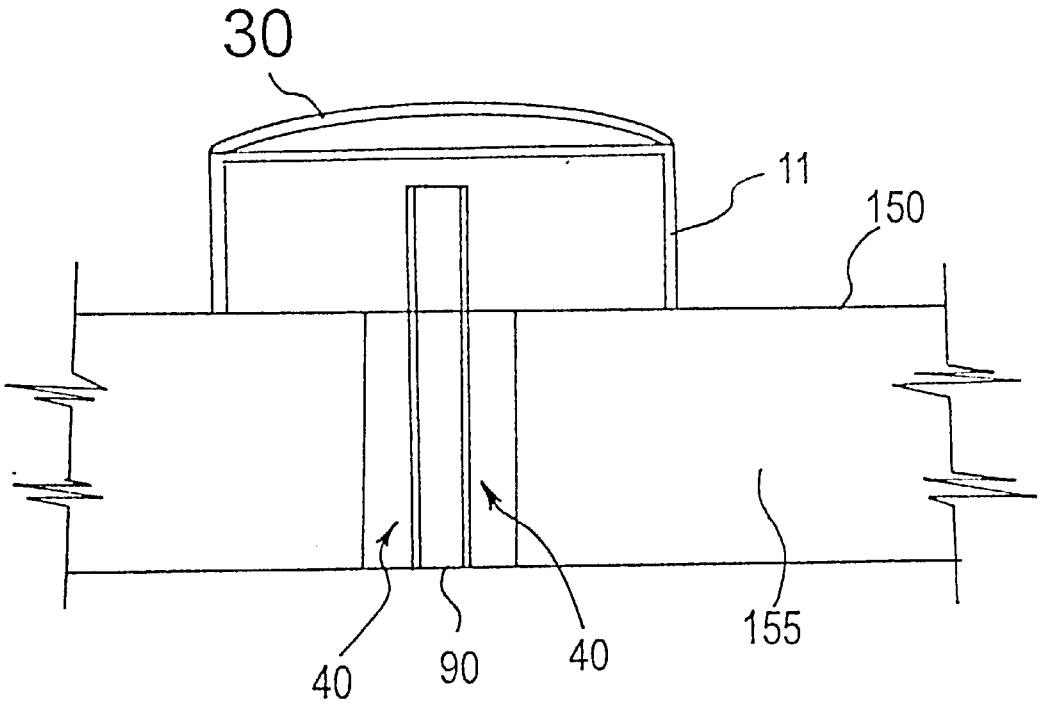
FIG. 6 is a side view of an alternative embodiment of a blade and housing.

In a still further alternative embodiment, FIG. 6 illustrates an elongated blade 40 located within a housing 11. Housing 11 may be affixed to the upper surface 132 of a snowboard 150, and is adapted to receive a boot or other conventional binding systems. The blade 40 extends through a slot 160 or aperture within the core 155 of the board 150, when actuated by suitable actuation means. Desirably, the bottom surface 90 of the guide blade 40 is flush or co-planar with the bottom surface 130 of the board 150 when in a non-actuated position.

Figure 7:
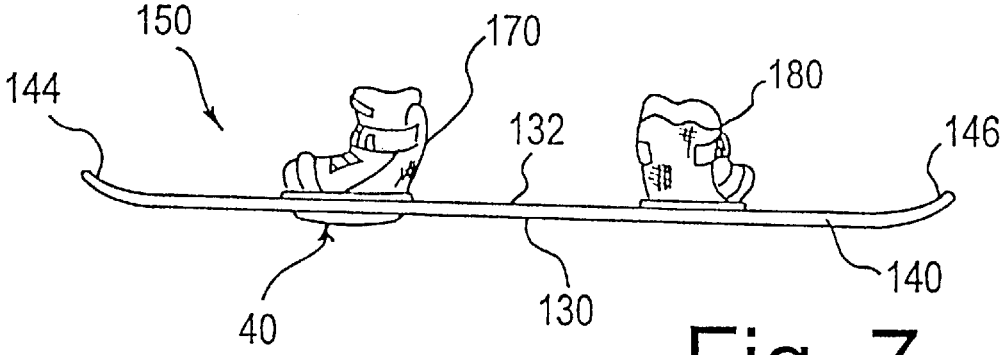
FIG. 7 is a side view of an improved snowboard according to a preferred embodiment.

A further embodiment is shown in FIGS. 7 through 13. A modified snowboard 150 as illustrated in FIG. 7 includes an upper surface 132, a bottom surface 130, a continuous side 140, a forward or front portion 144, a rear or tail portion 146 and a blade or skate portion 40 (shown in an extended position). As illustrated, the front or forward facing portion 144 is preferably angled in an upward direction, while the rear portion or tail 146 is also angled in a generally upward direction. It is understood that the present invention may be adapted for use with various types of snowboards, for example, carving boards, boards designed for powder or slalom boards, etc., or the like, and that the present invention described herein is not limited to such.

Bindings 170 and 180 are positioned on the upper surface 132 of the snowboard 150 in a conventional manner, and may be mounted according to industry standards or dimensions in appropriate mounting areas suitable to the requirements of the board and its intended use.

FIG. 7 illustrates a modified snowboard 150. As shown, the modified snowboard 150 is provided with a blade or skate 40, which, when actuated by rotation of the binding by the rider, extends from the bottom surface 130 of the snowboard 150 to provide guide means to aid the user in controlling the direction of the snowboard 150 when being pushed or propelled by the rider, which may also be referred to as scooting, skating or pushing. The blade or skate 40 when not in use is recessed within the core 155 of the snowboard 150, and is described in greater detail below.

Figure 8:
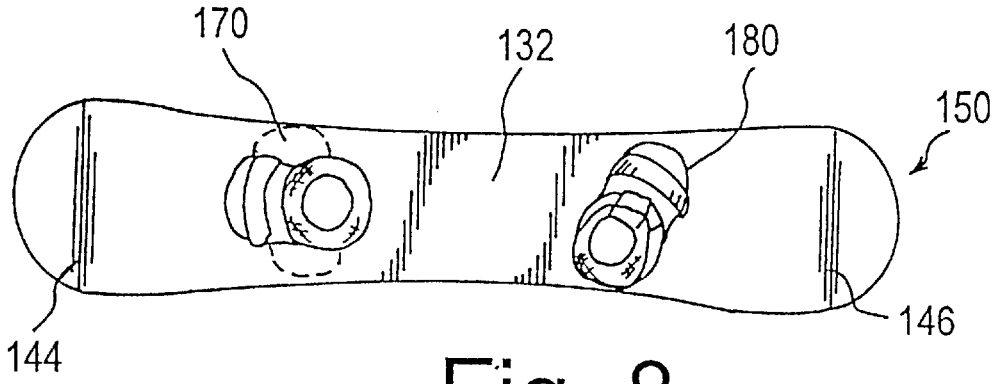
FIG. 8 is a top view of FIG. 7.

In a preferred alternative embodiment, as shown in FIG. 8, the modified snowboard 150 includes multi-position front and rear bindings 170 and 180 respectively, are able to pivot from a first position to at least a second position. As illustrated in this example, the skate or blade portion 40 is positioned beneath the foremost or front binding 170. Desirably, the snowboard may include one blade 40 by rotation of the binding. The actuating device 10 may be integrated with the binding 170 such that when the binding 170 is rotated between a non-use and in-use position, a portion of the blade 40 is extended or retracted. As the rider or user rotates the binding between the preset positions, the skate or blade portion 40 extends through the insert 20 within the core 155 of the snowboard 150, and protrudes from the bottom surface 130 of the board 155 such that the blade 40 will act as a keel or rudder for the snowboard 150 to help stabilize the board while the user or rider is pushing or steering the board during skating.

The actuating means or device 10 may be of any conventional construction, that is adapted to extend and retract the blade 40 when desired. Preferably, the actuating means 10 includes a lever or cam wherein the rider actuates the blade 40 by lifting the lever or cam to extend the blade from within the insert 20 while rotating the binding.

Typically, snowboards have a generally minimal board thickness. Snowboard manufacturers design various boards for various purposes such as carving freestyle etc., and the thickness of the boards will vary depending on the function of the board. Desirably, the blade 40 is mounted immediately below the bindings or mounting areas for the bindings (170 or 180). The blade 40, for exemplary purposes only, may extend from the bottom surface 30 of the snowboard 150 from approximately a 0.05 of a millimeter to a few centimeters, and preferably has a length from about 1 to 30 centimeters, and most preferably in the range of 5 to 20 centimeters. As understood, the extended length and width of the blade 40 will vary depending on the length and thickness of the board and the design or purpose of the board.

Figure 9:
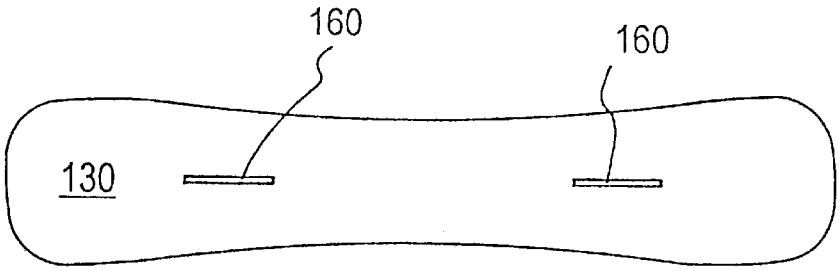
FIG. 9 is a top view of the snowboard of FIG. 7.

FIG. 9 is an alternative embodiment wherein the snowboard 150 is provided with a pair of blades 40, each blade mounted or positioned beneath the bindings 170 and 180. Desirably, each blade 40 and actuating device 10 could be affixed and operated in the same manner as described above and in further detail below. In a further alternative, embodiment, the blade 40 and the actuating means 10 may be in the form of an insert, adapted for use with conventional bindings, wherein an existing board may be modified to include the insert, as shown in FIGS. 3 and 4.

Figure 10:
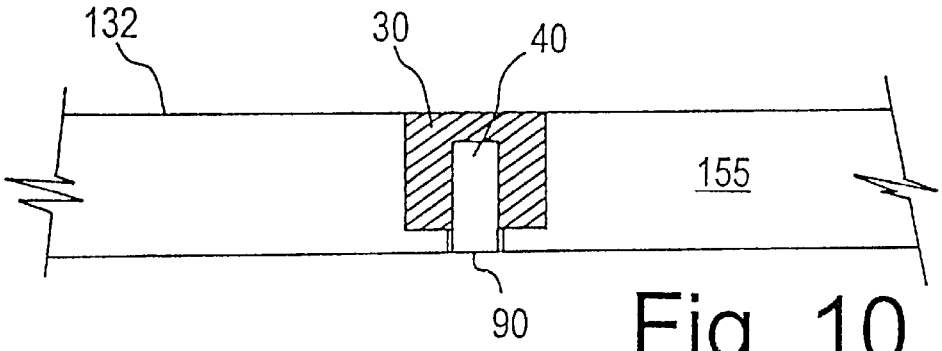
FIG. 10 is a front view of a portion of a snowboard showing a blade in a retracted position.
Figure 11:
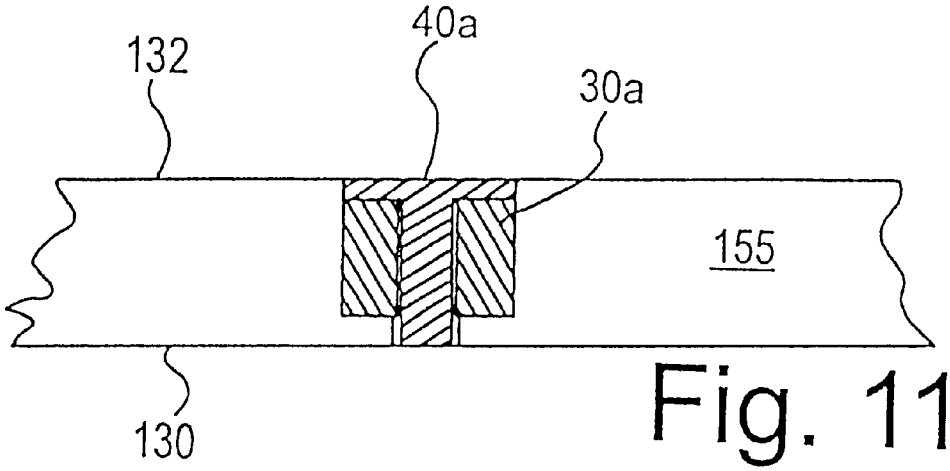
FIG. 11 is a front view of alternative embodiment of the blade of FIG. 10, shown in a retracted position.

The blade 40 is shown in greater in FIGS. 10 and 11 in a retracted or non-use position and an in-use or extended position. In FIG. 10, the blade 40 is shown in a retracted position, for example during normal snowboarding use or activity. The blade 40 is housed within the core 155 in a recess or slot 160, and is affixed within the slot or recess 160 through a flexible material 30. The flexible material 30 may be of any conventional material known in the art, or other suitable material able to remain flexible under cold conditions. In the present embodiment, flexible material 30 may be injected, precast or adhered into place with the blade 40. Flexible material 30 is preferably affixed to a portion of the blade 40, and is adapted to travel between a non-actuated position within the core 155 of the snowboard 150 and an extended position wherein the flexible material 30 is parallel with the bottom surface 130 of the snowboard 150. The actuating means 10, which may be used as either a stand alone device or in combination with the multi-position bindings, provides the necessary force to retract or extend the guide means 40. Additionally, the blade 40 may be constructed of a material adapted to provide a non-stick surface. Examples of such type of materials would be Teflon type non stick material. Teflon or non stick coating materials could also be employed to ensure a non-stick blade.

Figure 10A:
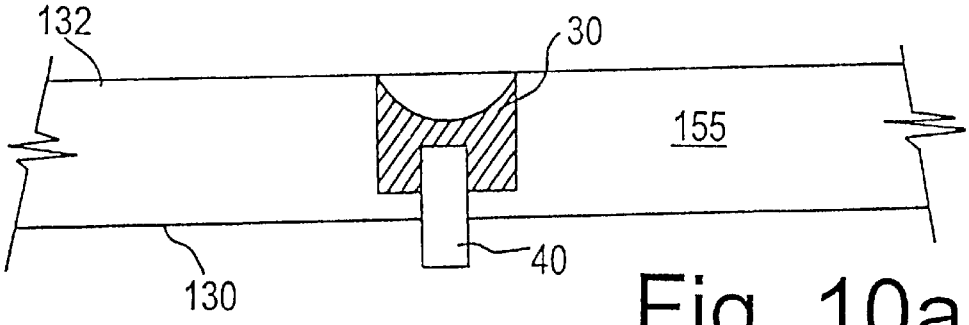
FIG. 10A is a front view of a blade in FIG. 10.

FIG. 10*a* illustrates the blade portion 40 in an extended or in-use position. As shown, the flexible material 30 is co-planar with the bottom surface 130 of the snowboard 150. This co-planarity ensures that the blade 40 is fully extended to allow for greater control of the board during a pushing, steering or skating activity.

FIG. 11 illustrates an alternative view of FIG. 10, wherein the holder or insert 20 and the guide blade 40 is replaced by a single T-shaped blade 40*a,* within a recess 160*a*. Desirably, the skate or blade 40*a* preferably is, substantially co-planar with the bottom surface of the snowboard. As shown, flexible material 30*a,* as selected from the above material, or alternatively springs or the like, is affixed to at least a portion of the t-shaped blade 40*a* in order to provide a compressive resilient or elastic member.

Figure 11A:
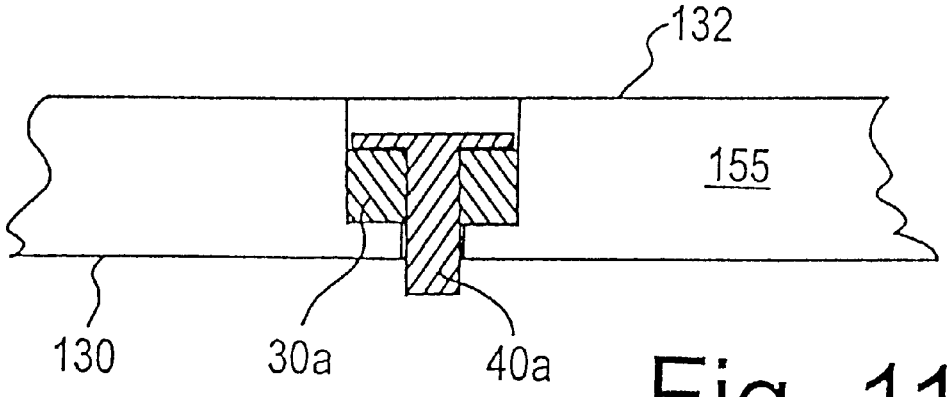
FIG. 11A is a front view of the blade of FIG. 11 in an extended position.

FIG. 11*a* illustrates the blade portion 40*a* in an extended or in-use position. As shown, the flexible material 30*a* has been compressed within the recess of the board, and at least a portion of the blade 40*a* has been extended beneath the bottom surface of the snowboard 150.

Both FIGS. 10 and 11 can be used in conjunction with an insert 20 or 800 as described below.

Figure 12:
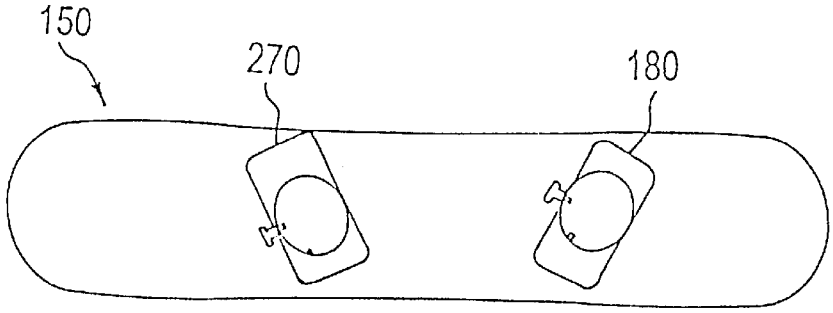
FIG. 12 is a top view of a snowboard according to the present invention illustrating preset binding positions during normal use.

FIG. 12 illustrates a snowboard 150 with the binding portions 170 and 180 in an in-use or snowboarding position. As illustrated, the bindings 170 and 180 are in a preset position for snowboarding, ensuring that the blade 40 is in a retracted position. The preset position may be set using stops, releasable pins, quick release levers or bindings etc., to ensure that the snowboard binding does not release or move to a different setting.

Figure 13:
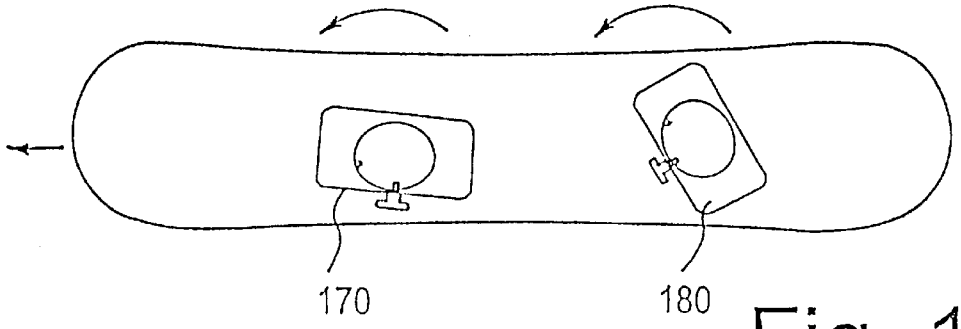
FIG. 13 is a top view of the snowboard of FIG. 12 illustrating bindings in a skating position.

FIG. 13 illustrates a snowboard 150 where the bindings are in a steering or skating position. The bindings 170 and 180 have been rotated such that the users's feet are positioned such that the guide means or blade 40 has been extended and the rider can maintain control over the direction of the board while pushing with the opposite foot.

Binding 170, as illustrated in FIG. 13, has been rotated, in this example, to allow the users front foot to face towards the front 144 of the snowboard 150. As illustrated, the rotation of the front or foremost binding permits the rider to engage the blade 40 through the actuation means 10, or 200, and to provide the user a more ergonomic body position in order to push or propel the board and the user forward.

Alternatively, the present invention may be used in combination with rotatable binding systems. When used in combination with rotatable bindings, where at least one of the bindings (170 or 180) is able to swivel and engage with the blade 40, such that the blade 40 is pushed or extended beneath the bottom surface 130 of the snowboard 150.

Figure 14:
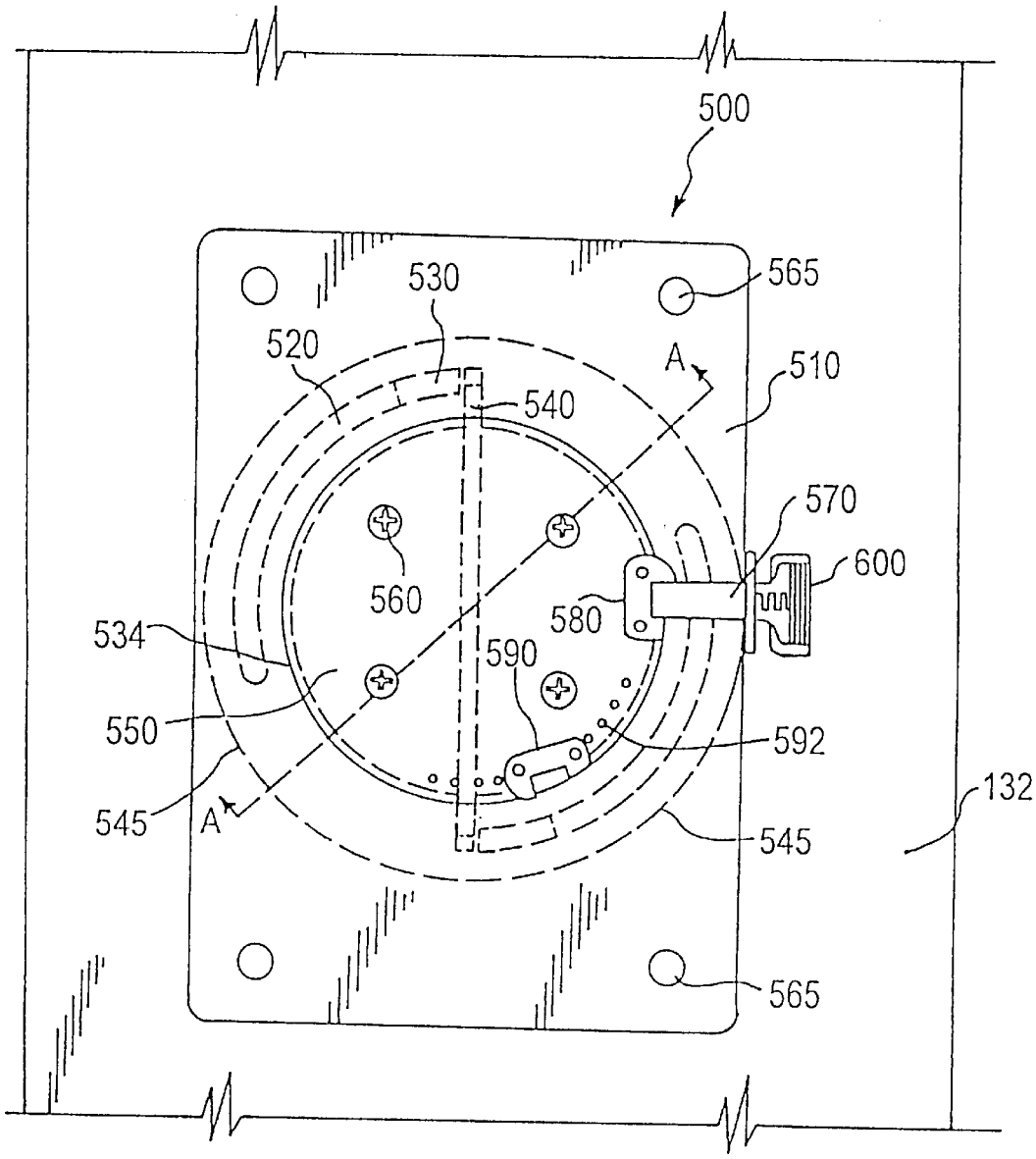
FIG. 14 is a top view of a swivel type rotatable binding with skate.

FIG. 14 illustrates an alterative embodiment of the present invention. As illustrated, there is provided a swivel plate system incorporating a blade suitable for use with a retractable blade according to one embodiment of the present invention. As shown, there is provided a multi-position rotatable binding and skate system generally indicated by reference number 500, which includes a swivel plate or base 510, an anchor plate 550, a plurality of slots or grooves 520 (shown in phantom) including on at least one end 530 a tapered area thereof, a generally circular inner peripheral edge 534 for guiding the swivel plate 510 around anchoring plate 550.

The combination of the binding shown in FIG. 14, and the guide means previously described, can be provided as a "set" which may be manufactured and sold for application to any conventional snowboard, in which the snowboard is either provided with a recess for receiving the guide means, or alternatively, the snowboard is modified to include such a recess or aperture. Thus, the binding shown in FIG. 14 may be subsequently mounted to the upper surface of a snowboard over the area in which the recess is located, and in turn, the guide means mounted in the recess by suitable securing means.

Anchor plate 550, as illustrated, is a generally circular, and has a "T" shaped configuration when seen in profile as shown, and is adapted to hold the rotatable plate 510 against the snowboard surface 132. Desirably, there is provided a seal 545, shown in phantom lines, mounted to the swivel plate 510, proximate the slots or grooves 520 which would prevent snow or ice from building up within the slots 520 or edges 530.

Suitable fastening means 560, such as mounting screws, are provided to secure the anchor plate 550 to the snowboard 132. Compatible binding mounting means, shown generally as reference numeral 565, may be used with conventional snowboard binding systems. A boot catch structure, not shown, such as a quick release bindings or the like, may be utilized with the present embodiment as part of or in combination with the multiple position system 500.

A skate blade 540 is shown in phantom lines mounted directly beneath the swivel plate 510 and retained within the core of a snowboard. Suitable slots, for example slot 160 as described above, or apertures under the swivel plate and suitable actuation means, as described above, may be utilized to affix the retractable blade 540 in operative association with the multi-position binding system 500.

Mounted to the anchor plate 550 are end engaging stops, 580 and 590. Stop 580 as shown is mounted to the plate 550. Adjustable stop 590 is adjustable through removable screws, pins or the like, which are adapted to fit into corresponding apertures 592 in plate 550. In a normal snowboarding position, or use, the adjustable stop 590 may be positioned by the rider into various apertures 592 in order to set the rider's boot or binding to a desired angle relative to the longitudinal axis of the board.

A release handle 600 is provided to disengage pin 570 from stops 580 and 590. Handle 600 may be of a conventional type release handle, such as spring-loaded, cam operated, quick-release or the like, which is adapted to release the swivel plate 510 from a blade extended position to a blade retracted position. As illustrated in FIG. 14, the handle 600 is engaged with stop 580, which has rotated the binding such that the skate 540, which is operatively mounted beneath the swivel plate 510, is in an extended or in-use position. When desired, the rider releases the handle 600 to disengage pin 570 from stop 580 from a skating or pushing position, the rider positions the handle 600 to position the pin 570 to lock the pin 570 into place within stop 590, or a snowboarding position or pin 570 engages automatically when binding is rotated to the desired end position.

Figure 15:
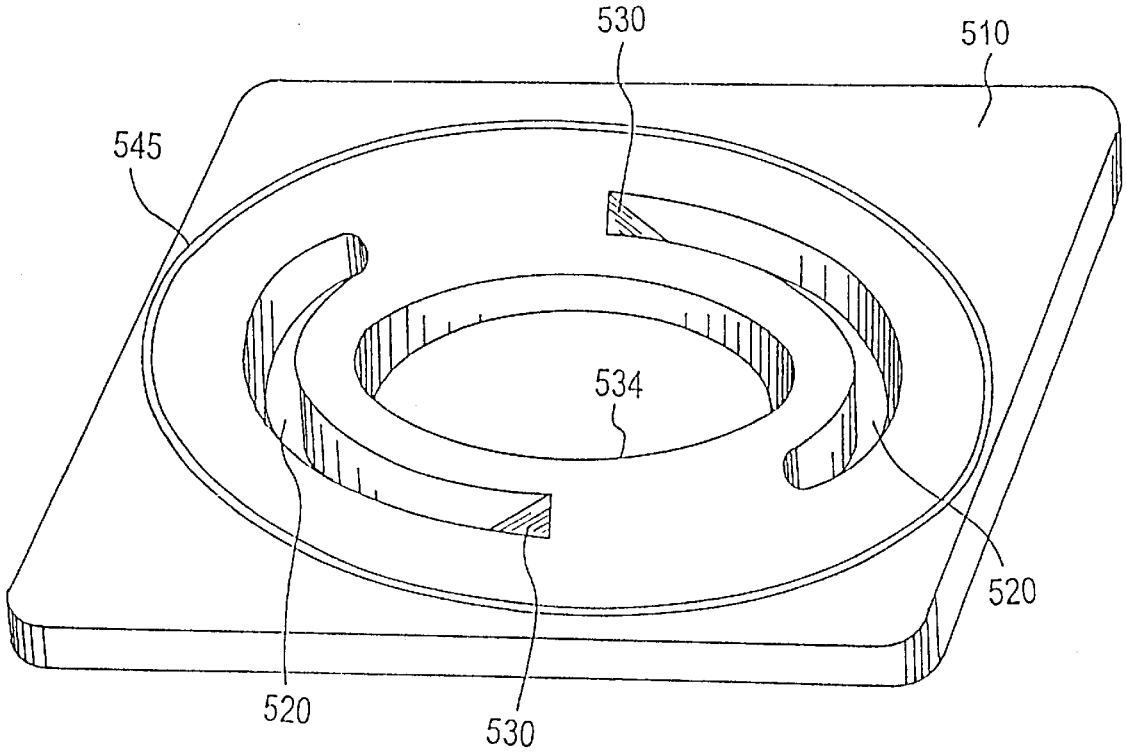
FIG. 15 is a bottom view of FIG. 14.

FIG. 15 is a bottom view of FIG. 14, illustrating the slots or grooves 520, the tapered areas 530 and a seal 545. The slots 520 allows for the swivel plate to clear from engaging with an upper surface of the blade 540 when the swivel or binding is in a snowboarding position. Tapered areas 530 are adapted to provide for the gradual engagement of the swivel plate 510 with an upper surface 50 of a skate or blade 40 as described above.

In use, as the swivel plate 510 is rotated and engages with the upper surface 50 of the blade or skate, the plate 510 forces the blade 40, not shown, from within the slot 160 into an in use or extended position beneath the lower surface of the snowboard. The seal 545 as illustrated is positioned adjacent the outside facing side or periphery of the slots 520. The seal 545 may be of a conventional type, able to remain flexible under cold conditions and is adapted to prevent snow or ice from entering the slots 520 or ends 530, such that rotation of the swivel plate is not impaired from snow or ice plugging the slots or grooves.

Figure 16:
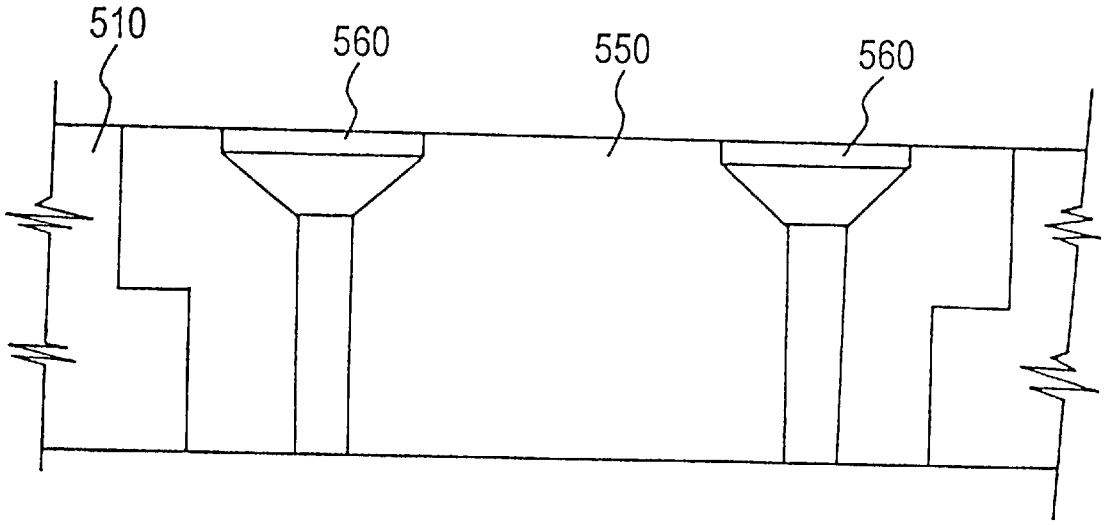
FIG. 16 is a side view of the swivel plate of FIG. 14.

FIG. 16 illustrates an enlarged view of the swivel plate 510 in position around the anchor plate 550. As shown, the anchor plate 550 is adapted to center and guide the swivel plate in position.

Figure 17:
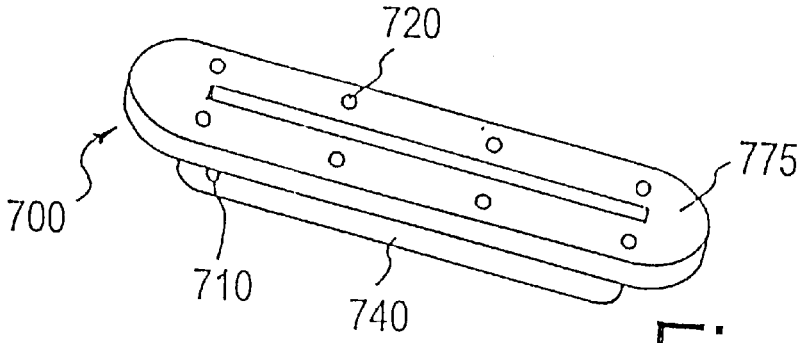
FIG. 17 is an side elevational view of a guide blade insert.

FIG. 17 is an enlarged view of the retractable guide means 700, illustrating a mounting plate 775, including suitable fastening means 720 to affix the guide 700 to a snowboard. Desirably, fastening means 720 may also be used to mount thereto conventional bindings, or other binding or mounting systems eliminating the need of pre-installed threaded inserts.

Figure 18:
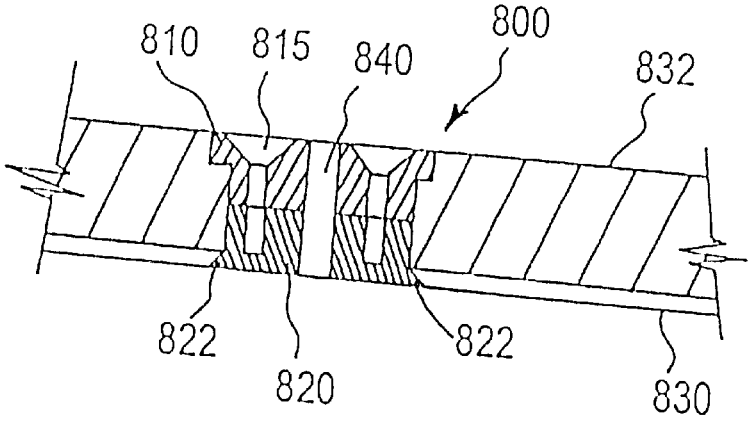
FIG. 18 is a front view of a composite retractable guide blade insert.

FIG. 18 illustrates an alternative embodiment of a retractable guide means including an insert 800. Snowboards are often manufactured from a variety or materials, and as such various types of snowboards may be formed from multiple layers of different material. Such snowboards, when an aperture or slot is formed therein, may require additional support. Insert 800 as illustrated is provided with a movable blade 840, an upper portion 810 and a lower corresponding portion 820. Mounting screws 815 are provided to secure the upper and lower portion to each other. As shown, the two piece insert 800 is adapted to be affixed to an upper and a lower surface (832 and 830 respectively) of a snowboard. Desirably, the lower or bottom portion 820 includes tapered edges 822, which provide additional support to the board near the slot, and also serve to protect the base or bottom sliding surface.

In another alternative embodiment, the retractable blade may be formed as an insert, having one or more sections, i.e. an upper and a lower section. Desirably, sections are adapted to be fitted onto a pre-existing snowboard, or may be incorporated into the snowboard during its manufacture.

In a still further alternative embodiment, the retractable guide blade may have an inverse configuration to the above embodiments, wherein the lower portion or section is substantially larger than the upper portion or section and is adapted to house the blade. For example, the configuration of the insert could be in an inverse "T" shape, where the actuation means would engage through from an upper surface of the snowboard.

The above embodiments are for illustrative purposes only, and as such various modifications are possible without departing from the scope and spirit of the invention. For example, various blade configurations could be used, as well as various binding systems can be adapted for use with various types of blades or guide means for different types of boards.

I claim:

1. A snowboard having a rotatable binding and retractable guide means, said guide means facilitating tracking of said snowboard and comprising: a movable blade movable between a first retracted position within said board and a second extended position exteriorly of a bottom surface of said board, said rotatable binding being rotatable between first and second positions and being operatively associated with said guide means, said guide means being actuatable between said first retracted position and second extended positions by rotation of said binding between said first and second positions.

2. A snowboard as defined in claim 1, wherein said board includes spaced apart upper and bottom surfaces with a core therebetween, said core having an aperture extending inwardly from said bottom surface and adapted to receive said blade when in a retracted position.

3. A snowboard as defined in claim 1, wherein said blade is resiliently bias to one of said first or second positions.

4. A snowboard as defined in claim 3, wherein said board includes an insert for retaining said blade within said aperture when said blade is in a retracted position, said insert having a flexible structure adapted to engage opposed sides of said blade, said flexible structure being positioned within said aperture to prevent snow or ice interfering with movement of said blade.

5. A snowboard as defined in claim 1, wherein said binding includes rotatable means operatively associated with said guide means whereby rotation of said binding is effective to lower said blade from said first position to said second position.

6. A snowboard as defined in claim 1, wherein said binding is mounted to an upper surface of said snowboard and includes rotatable means, said guide means being mounted beneath said binding whereby rotation of said rotatable means is effective to lower said blade from said first position to said second position.

7. A snowboard as defined in claim 1, wherein said binding means comprises a rotatable assembly rotatable between first and second positions, said assembly including a swivel plate, guide means for guiding said swivel plate between said first and second positions, means for retaining said rotatable assembly fixedly secured to an upper surface of said snowboard.

8. A snowboard as defined in claim 7, further including a seal for preventing snow or ice build-up relative to said guide means.

9. A snowboard as defined in claim 7, wherein said binding means includes release means operatively associated therewith for releasably engaging a boot for use with said binding.

10. A snowboard as defined in claim 9, further including at least one adjustable stop means for fixing a user's boot or binding to a desired angle relative to a longitudinal axis of said snowboard.

11. A snowboard as defined in claim 10, further includes manually engageable means operatively associated with at least one of said stops to release said swivel plate from, a fixed position.

12. A snowboard as defined in claim 7, wherein said swivel plate includes means for releasably engaging releaseable contact with said movable blade.

13. For use in a snowboard, the combination of rotatable binding means and guide means, said guide means comprising a movable blade movable between a first retracted position with the snowboard and a second extended position exteriorly of a bottom surface of the snowboard, said rotatable binding means comprising a rotatable binding secured to the snowboard and adapted to retain a snowboard user's foot, said rotatable binding means being rotatable between first and second positions and being operatively associated with said guide means whereby said rotatable binding means when assembled to the snowboard operates to actuate said moveable blade between said first retracted position and said second extended position by rotation of said rotatable binding means between said first and second positions.

14. A binding according to claim 13, wherein said blade includes means for resiliently biassing the blade in one of said first or second positions when said blade is incorporated into a snowboard.

15. A binding according to claim 13, wherein said guide means includes an insert adapted to be positioned in an aperture in a snowboard to receive said blade of said guide means when in a retracted position, said insert comprising a flexible housing adapted to engage opposed sides of said blade when said blade is in a retracted position in a snowboard to prevent snow or ice interfering with the movement of said blade.

16. A binding according to claim 13, wherein said binding includes rotatable means operatively associated with said guide means whereby rotation of said rotatable means of said binding lowers said blade from said first position to said second position.

17. A binding according to claim 13, wherein said binding means comprises a rotatable assembly rotatable between first and second positions, said assembly including a swivel plate, guide means for guiding said swivel plate between said first and second positions, means for retaining said rotatable assembly fixedly secured to an upper surface of said snowboard.

18. A binding according to claim 17, further including at least one adjustable stop means for fixing a user's boot or binding to a desired angle relative to a longitudinal axis of said snowboard.

19. A binding according to claim 17, further including manually engageable means operatively associated with at least one of said stops to release said swivel plate from a fixed position.

20. A binding according to claim 17, wherein said swivel plate includes means for releasable engaging contact with said movable blade.

* * * * *